United States Patent [19]

Riddling

[11] Patent Number: 4,685,601

[45] Date of Patent: Aug. 11, 1987

[54] FIRE HOSE BACK PACK

[76] Inventor: Charles C. Riddling, 6362 Bahaia Rd., Green Cove Springs, Fla. 32043

[21] Appl. No.: 877,136

[22] Filed: Jun. 23, 1986

[51] Int. Cl.[4] ..... A45F 3/08; A47G 29/00

[52] U.S. Cl. ..... 224/261; 248/89; 224/153

[58] Field of Search ..... 224/153, 210, 211, 215, 224/209; 248/75, 78, 79, 89, 90; 211/107, 60.1; 242/85, 86, 96

[56] References Cited

U.S. PATENT DOCUMENTS

| | | | |
|---|---|---|---|
| 357,900 | 2/1887 | Boyle | 248/89 |
| 2,266,334 | 12/1941 | Rice | 224/209 |
| 2,384,174 | 9/1945 | Jones | 248/79 X |
| 2,725,208 | 11/1955 | Boua | 248/89 |
| 2,757,958 | 8/1956 | Bussey et al. | 248/79 X |
| 2,888,217 | 5/1959 | Zierden | 242/86 |
| 2,943,775 | 7/1960 | Mack | 224/211 |
| 3,035,747 | 5/1962 | Ulbrich, Jr. | 224/262 X |
| 3,378,222 | 4/1968 | Erickson | 248/89 X |
| 3,722,823 | 3/1973 | Reich et al. | 224/162 X |
| 3,942,636 | 3/1976 | Matsuyama et al. | 150/52 R X |
| 4,506,853 | 3/1985 | Cathey | 248/79 |

*Primary Examiner*—Stephen Marcus
*Assistant Examiner*—Robert M. Petrik
*Attorney, Agent, or Firm*—Arthur G. Yeager

[57] ABSTRACT

A back pack releasably attachable to the compressed air cylinder of the self-contained breathing apparatus carried on the back of a fire fighter, the back pack being loaded with lengths of two sizes of fire hose and appropriate fittings, the back pack having a vertical spine and a horizontal cross arm at each end of the spine, spring clips attached to the spine for releasable attachment to an air cylinder, and belt fasteners to hold the fire hose onto the back pack, a seat for engaging the bottom of the air cylinder, and a handle for manually lifting the back pack.

12 Claims, 7 Drawing Figures

FIRE HOSE BACK PACK

BACKGROUND OF THE INVENTION

In fighting fires the handling of fire hose, frequently in very long lengths, is always a problem. Reels or coils of hose are cumbersome and easily entangled. Such handling problems are multiplied many fold when the fire is in a high rise building where fire hose must be carried up elevators or many flights of stairs. A fire fighter needs his hands to be free for whatever may be required, and the added problems of carrying fire hose is sometimes very dangerous. There has been a need for a long time for a means to carry long lengths of fire hose in a convenient manner while leaving the hands free to do whatever is necessary.

It is an object of this invention to provide an apparatus for carrying fire hose and associated equipment on the fire fighter's back. It is another object of this invention to provide a novel back pack of fire hose which is readily attachable to and detachable from the air cylinder of the self-contained breathing apparatus (SCBA) carried on the back of a fire fighter. Still other objects will become apparent from the more detailed description which follows.

BRIEF SUMMARY OF THE INVENTION

This invention relates to a fire hose back pack releasably attachable to a cylindrical air tank, said back pack comprising a central vertical frame member and a pair of horizontal arm members attached respectively to each end of said vertical member medially of said arm member, a pair of spaced circular spring clip members attached to said vertical member respectively, adjacent to and between said horizontal arm members, each said spring clip member being adapted to automatically grip around a compressed air cylinder upon being pressed against said cylinder, and a pair of flexible wrap-around fastening means attached respectively to the outer ends of one of said horizontal arms and adapted to encircle portions of fire hose lying between said ends and said spring clip members.

In specific embodiments of this invention the wrap-around fastening means are belts or covers which attach to each other by "Velcro" fastener components of fabric hooks and fabric loops.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 2:
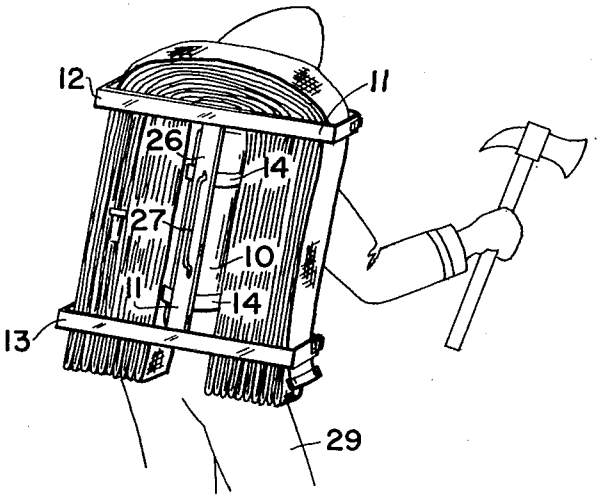
FIG. 2 is a schematic illustration of how the back pack would look when attached to an air cylinder carried on the back of a fire fighter.
Figure 1:
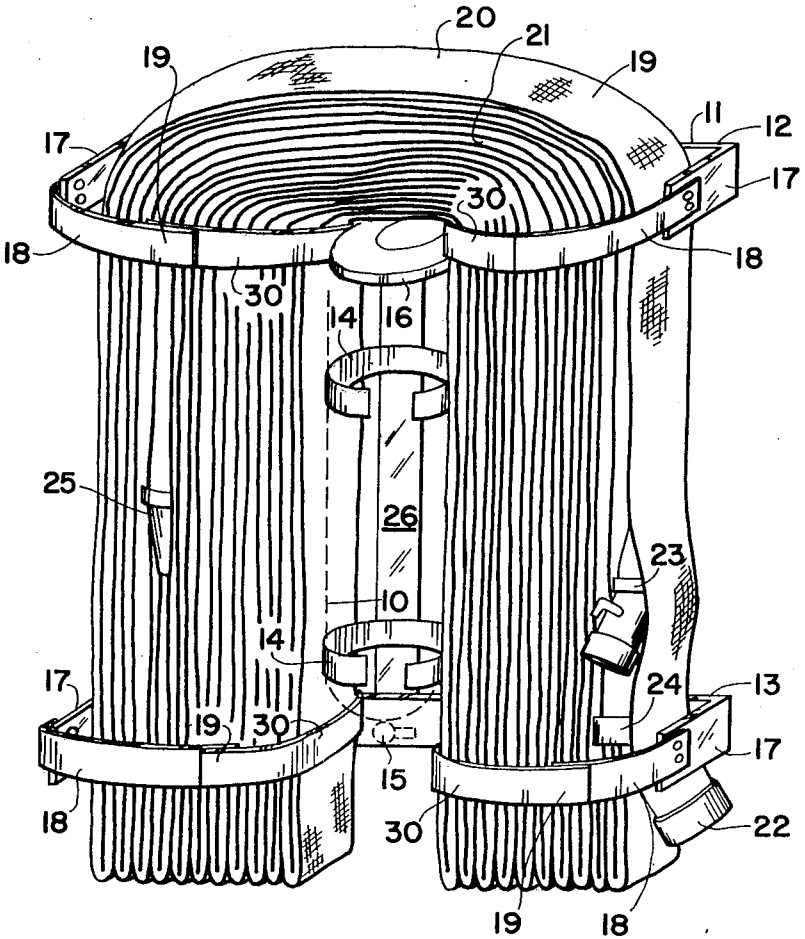
FIG. 1 is a perspective view of the back pack of this invention carrying lengths of fire hose and associated equipment ready to be clipped to an air cylinder.

In FIGS. 1–2 the back pack of this invention is shown loaded with fire hose and carried by a fire fighter. The structure of the back pack 11 includes a vertical channel spine 26 and two cross arms 12 and 13 which is loaded with two types of fire hose 20 and 21. Attached to channel spine 26 are two vertically spaced spring clips 14 of a size and shape to be attached to the compressed air cylinder 10 of an SCBA carried by a harness on the back of a fire fighter 29. All that is necessary to attach the loaded back pack 11 is to push the loaded pack 11 against air cylinder 10 to cause the fingers of clips 14 to spread apart and spring back to a tight grip around cylinder 10. To detach the pack 11 from air cylinder 10 the reverse action is employed. A handle 27 attached to the back side of channel spine 26 facilitates the attachment or removal of back pack 11 from air cylinder 10. Of course, a second fire fighter is needed to attach pack 11 to cylinder 10, but this is no problem since it is common practice to require two fire fighters to work together. The removal of back pack 11 from air cylinder 10 can be readily accomplished without the assistance of a second fire fighter by using the leverage of any projecting structure or corner to pull the back pack 11 away from the cylinder 10. As shown in FIG. 2 the back pack 11 attached to the air cylinder 10 leaves the hands of the fire fighter 29 free to carry an axe or be available for any other purpose.

FIG. 1 shows other features of the back pack 11. It is appropriate to carry two sizes of fire hose, e.g., 10–12 feet of $2\frac{1}{2}$ inch hose 20 which can be connected to a hydrant, stand pipe, hose cabinet, or other suitable fire fighting connection by fixture 22. The remaining hose 21 is from 50 to 150 feet in each of two lengths of $1\frac{1}{2}$ inch hose with suitable fittings 24 and nozzles 25. Normally fittings 24 will be connected to a gated Y-fitting 23 having a quick opening gate valve in each leg of the Y. Such a Y-fitting is attached to the end of large hose 20 and provides connections for two smaller hoses 21. Thus back pack 11 is capable of carrying enough equipment to connect two lengths of $1\frac{1}{2}$inch fire hose to a hydrant. Other combinations of hose and/or equipment can, of course, be substituted for that shown and described here.

At each end of cross arms 12 and 13 there is a forwardly extending wing 17 which functions as a guide for placing hoses 20 and 21 on back pack 11. At the forward end of wings 17 there is attached an outer belt portion 18. An inner belt portion 30 is attached to respective cross arm 12 or 13 to cooperate with each outer belt portion 18 to form four encircling belts to hold hoses 20 and 21 in place. Any suitable fastener can be used to join outer belt portion 18 to inner belt portion 30, although a preferred fastener 19 is one employing fabric hooks on one portion to cooperate with fabric loops on the other portion. Such a fastener is commercially available as a "Velcro" fastener. The fastener 19 should be capable of rapid assembly and disassembly, which is a good feature of "Velcro". It is to be understood, however, that other fasteners are intended to be considered in this invention, e.g., buckles, snaps, ties, etc.

Air cylinder 10 is carried on the fire fighter's back with the valve 15 and associated high pressure hose attachment for the SCBA at the bottom so the fire fighter can reach it. In order to provide a good weight carrying ledge for back pack 11, a seat plate 16 is rigidly attached to channel spine 26 which will seat itself on the rounded bottom of air tank 10 and prevent back pack 11 from sliding down and off air tank 10.

Figure 3:
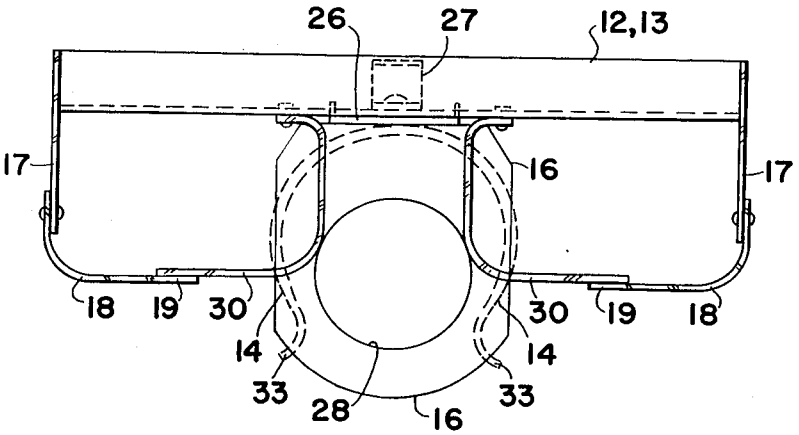
FIG. 3 is a top plan view of the back pack of this invention.
Figure 5:
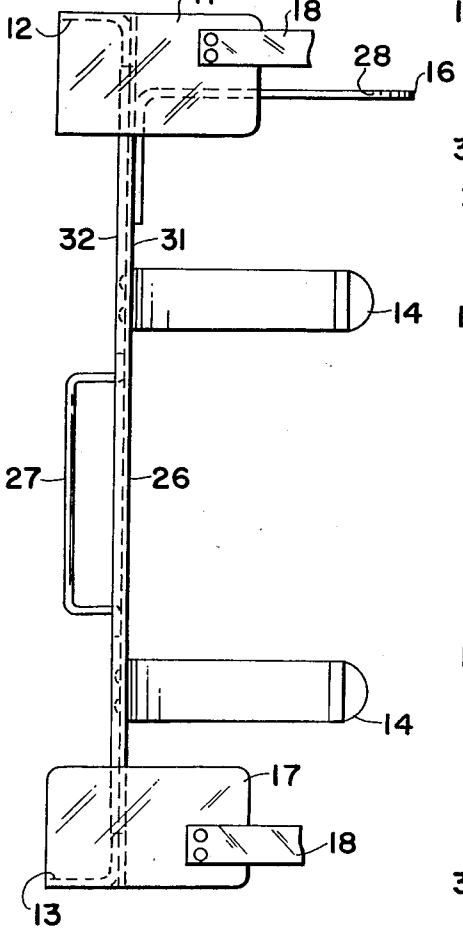
FIG. 5 is a side elevational view of the back pack of this invention.
Figure 4:
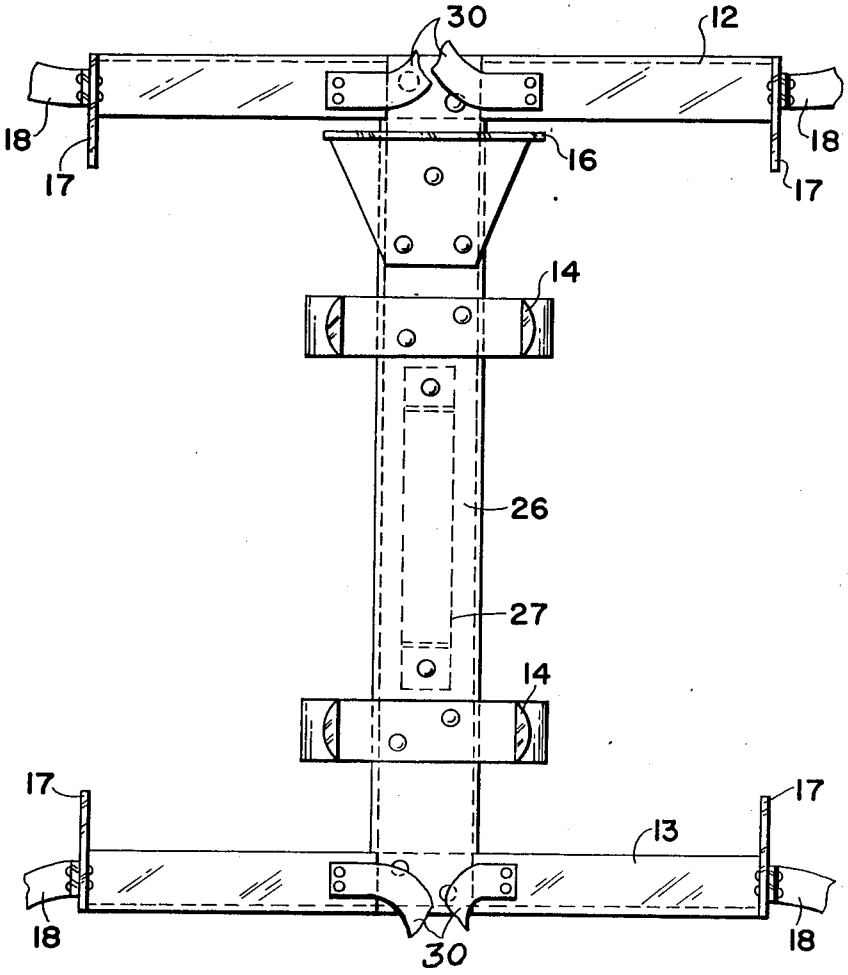
FIG. 4 is a front elevational view of the back pack of this invention.

The structural details of back pack 11 are best seen in FIGS. 3–5. A vertical channel member 26 forms the backbone of pack 11. At each end of channel 26 is a cross arm, upper cross arm 12 and lower cross arm 13, rigidly attached and perpendicular to channel 26. The method of attachment may be by welding, rivets, bolts and nuts, or the like. A suitable structural form for cross arms 12 and 13 is an angle (as seen in FIG. 5) although other forms such as tubes, channels, I-beam, etc., may also be employed. At the end of each cross arm 12 and 13 is a wing plate 17 facing forwardly with respect to the fire fighter. Wing plates 17 serve to contain the fire hose within a particular configuration, and also to be an anchor for outer belt portions 18. Inner belt portions 30 are attached to cross arms 12 or 13 adjacent channel member 26. Belt portions 18 and 30 each have a free end to which a fastening means 19 is attached so as to connect portions 18 and 30 to each other. A preferred fastening means is a "Velcro" fastener of fabric hooks and fabric loops. Belt portions 18 and 30 must be flexible and, therefore, may be fabric, leather, plastic, rubber, or metal chain; although fabric, such as canvas, nylon, or the like is preferred.

Channel member 26 has a front side 31 and a rear side 32 oriented with respect to the corresponding sides of the fire fighter wearing the back pack. Channel 26 is preferably oriented with its smooth side as front side 31 and its open channel side as rear side 32. On front side 31 there are rigidly attached two vertically spaced spring clip members 14. The spacing between clip members 14 is such that they will grip the upper and lower portions of an air cylinder. For the most common size of air cylinder the clips may be placed 9–12 inches apart to fit a cylinder approximately 5–8 inches in diameter. Preferably clip members 14 are circular in shape with two reverse turned lips 33 spaced apart from each other so that when pressed against the air cylinder, clips 33 will spread apart to admit the cylinder and then snap toward each other to encircle the cylinder in a snug grip. Preferably clips 14 are made of spring steel and coated with a tough nonabrasive plastic material. Seat plate 16 is also rigidly attached to channel member 26 adjacent upper cross arm 12 to form a seat for the rounded bottom of an air cylinder (which will have its valve and hose connection pointing downward adjacent lower cross arm 13). In order to seat a rounded bottom on the air cylinder a suitably sized hole 28 is formed in plate 16. Plate 16 actually forms a principal component in supporting the loaded back pack on the air cylinder and, therefore, must be sufficiently strong to resist bending and be firmly fastened to channel member 26, e.g., by rivets or the like. On the rear side 32 of channel spine 26 there is a handle 27 by means of which the back pack loaded with fire hose can be lifted and pushed against air cylinder 10 to attach the back pack thereto or to detach the back pack therefrom.

Back pack 11 components, such as channel spine 26, cross arms 12 and 13, handle 27, plate 16, and wing plates 17 should preferably be made of aluminum so as to provide strength and light weight. Other suitable materials are plastic, tungsten, steel, etc.

Figure 6:
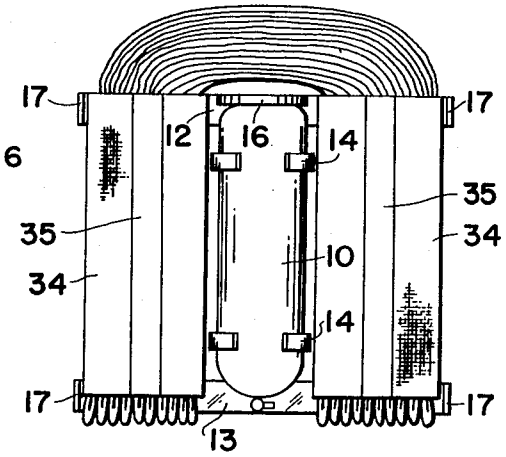
FIG. 6 is a schematic illustration of one embodiment of this invention where the fire hose is contained on the back by two socks fastened by a lengthwise strip of "Velcro" fastener.

In FIG. 6 there is shown an alternate embodiment of this invention. In this embodiment belts 18 and 30 are replaced with sheaths 34, preferably made of fabric, such as canvas or nylon, and closed with a lengthwise fastener, such as a zipper or a "Velcro" fastener. Sheaths 34 may be attached at the top and the bottom to wing plates 17 and at similar locations on cross arms 12 and 13 as are inner belt portions 30, described above. It is, of course, also suitable for sheaths 34 to be separate components not attached to the back pack structure. Sheaths 34 are advantageous in protecting ends of hose 20 or 21, fittings 22 or 24, Y connection 23, and nozzles 25 from catching on projections which obstruct the fire fighter's free passage.

Figure 7:
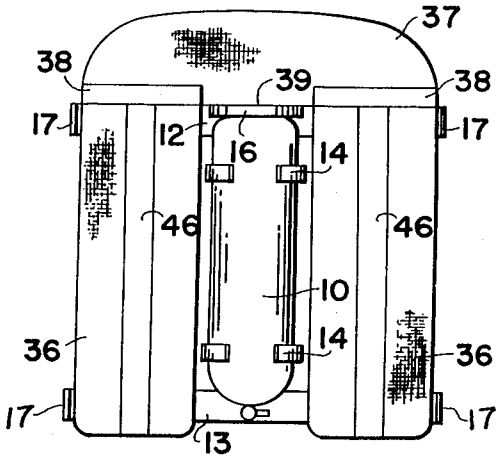
FIG. 7 is a schematic illustration of a second embodiment of this invention where the fire hose and fittings are totally enclosed by covers attached to the back pack and closed by "Velcro" fastener strips.

In FIG. 7 there is shown an alternate embodiment to that of FIG. 6. In this embodiment all of the hose and fittings are covered so as to leave no loose ends to be caught or snagged by any structure through which the fire fighter must pass. Sheaths 36 cover all of the vertical portions of hose lying on both sides of air cylinder 10. Each sheath has a vertical strip 46 of "Velcro" fastener extending the entire length necessary to cover the hose. A top cover 37 encloses all of the hose above the upper edges of sheaths 36. A "Velcro" fastener connects the bottom edge 39 of top cover 37 to the top edges of sheaths 36. Preferably sheaths 36 and top cover 37 are fastened to the back pack carrier at some convenient location, whether it be at wings 17, cross arms 12 and 13, or channel spine 26.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to be secured by Letters Patent of the United States is:

1. A fire hose back pack releaseably attachable to a cylindrical air tank, said back pack comprising a central vertical frame member and a pair of horizontal arm members attached respectively to each end of said vertical member medially of said arm member, a pair of spaced circular spring clip members attached to said vertical member respectively, adjacent to and between said horizontal arm members, each said spring clip member being adapted to automatically grip around a compressed air cylinder upon being pressed against said cylinder, and a pair of flexible wrap-around fastening means attached respectively to the outer ends of one of said horizontal arms and adapted to encircle portions of fire hose lying between said ends and said spring clip members.

2. The back pack of claim 1 wherein each said fastening means includes two belt portions with each portion having one end attached to said back pack and the other end being a cooperating half of a hook-and-loop fabric fastener.

3. The back pack of claim 2 wherein each said horizontal arm member has a pair of said fastening means attached thereto.

4. The back pack of claim 1 which additionally comprises a handle generally medially of the length of said vertical frame member and attached to said vertical frame member on the opposite side thereof with respect to said spring clip members.

5. The back pack of claim 1 wherein each said spring clip member is a generally U-shaped strip of spring steel coated with a plastic material.

6. The back pack of claim 1 which additionally includes a seat means projecting perpendicularly outward from and rigidly attached to said vertical frame member on the same side as said spring clips and being located adjacent one of said horizontal arms, said seat means being adapted to receive the rounded bottom of said compressed air cylinder.

7. A fire hose back pack adapted to be releasably attached to a compressed air cylinder strapped to the back of a fire fighter, said back pack comprising a central vertical channel spine having a top, a bottom, a front and a back with respect to said fire fighter and having rigidly attached thereto two vertically spaced U-shaped spring clips projecting perpendicularly outward from said front with the open side of said clips facing said front, an annular plate seat rigidly attached to said channel spine and projecting perpendicularly outward from said front, spaced upwardly from the uppermost of said spring clips, a manual lifting handle rigidly attached to said back of said channel spine medially lengthwise thereof, two horizontal cross arms medially and rigidly attached respectively to said top and said bottom of said channel spine with a forwardly projecting foot plate at each end of each said cross arm; and a pair of wrap-around fastening members attached respectively to each end of one of said cross arms.

8. The back pack of claim 7 wherein said fastening members are belts adapted to encircle closely packed layers of fire hose.

9. The back pack of claim 8 wherein said belts are fastened together by cooperating fabric hooks and fabric loops.

10. The back pack of claim 7 wherein said fastening members comprise a fabric cover adapted to enclose a substantial portion of fire hose carried on said back pack by means of a lengthwise fastening means.

11. The back pack of claim 10 wherein said fastening members include a top cover and two vertical sheaths joined to each other by fasteners of fabric hooks and fabric loops, said members in combination totally enclosing the fire hose and fittings on said back pack.

12. The back pack of claim 8 wherein each end of each said cross arm includes a belt fastening means.

* * * * *